US009355632B2

(12) United States Patent
Rodigast

(10) Patent No.: US 9,355,632 B2
(45) Date of Patent: May 31, 2016

(54) APPARATUS, METHOD AND ELECTROACOUSTIC SYSTEM FOR REVERBERATION TIME EXTENSION

(71) Applicant: Fraunhofer-Gesellschaft zur Foerderung der Angewandten Forschung e.V., Munich (DE)

(72) Inventor: Rene Rodigast, Tautenhain (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 113 days.

(21) Appl. No.: 14/199,362

(22) Filed: Mar. 6, 2014

(65) Prior Publication Data

US 2014/0185817 A1 Jul. 3, 2014

Related U.S. Application Data

(63) Continuation of application No. PCT/EP2012/066392, filed on Aug. 23, 2012.

(60) Provisional application No. 61/531,899, filed on Sep. 7, 2011.

(30) Foreign Application Priority Data

Sep. 7, 2011 (DE) ..... 10 2011 082 310

(51) Int. Cl.
*G10K 15/08* (2006.01)
*G10K 15/12* (2006.01)

(52) U.S. Cl.
CPC ..... *G10K 15/08* (2013.01); *G10K 15/12* (2013.01)

(58) Field of Classification Search
CPC ..... G10K 15/08; G10K 15/12
See application file for complete search history.

(56) References Cited

U.S. PATENT DOCUMENTS 3,614,320 A 10/1971 Volkmann
5,109,419 A 4/1992 Griesinger (Continued)

FOREIGN PATENT DOCUMENTS

CN 1826838 A 8/2006
CN 101129089 A 2/2008

(Continued)

OTHER PUBLICATIONS

Boone, M., "Acoustic rendering with wave filed synthesis", ACM Siggraph and Eurographics Campfire: Acoustic Rendering Forvirutal Environments; pp. 1-9.

(Continued)

*Primary Examiner* — Sonia Gay
(74) *Attorney, Agent, or Firm* — Perkins Coie LLP; Michael A. Glenn

(57) ABSTRACT

An apparatus for reverberation time extension is provided. The apparatus includes a module for calculating wave field synthesis information, and a signal processor for generating a plurality of audio output signals for a plurality of loudspeakers based on the audio input signals that have been recorded by a plurality of microphones, and based on the wave field synthesis information. Further, the apparatus includes an operating unit for determining a virtual position of one or several virtual walls. The module for calculating wave field synthesis information is implemented to calculate the wave field synthesis information based on the virtual position of the one or several virtual walls. Further, the virtual position is adjustable by the operating unit for at least one of the virtual walls.

15 Claims, 8 Drawing Sheets

(56) References Cited

U.S. PATENT DOCUMENTS

| | | | | |
|---|---|---|---|---|
| 5,142,856 | A | 9/1992 | Nakayama et al. | |
| 5,452,360 | A | 9/1995 | Yamashita et al. | |
| 6,111,962 | A * | 8/2000 | Akio | G10H 1/0091 381/104 |
| RE39,189 | E | 7/2006 | Poletti | |
| 7,684,578 | B2 | 3/2010 | Roeder et al. | |
| 7,751,915 | B2 | 7/2010 | Roeder et al. | |
| 8,755,922 | B2 | 6/2014 | Reichelt et al. | |
| 2008/0279389 | A1 | 11/2008 | Yoo et al. | |
| 2011/0188342 | A1 | 8/2011 | Sporer | |

FOREIGN PATENT DOCUMENTS

| | | | |
|---|---|---|---|
| CN | 101978424 | A | 2/2011 |
| DE | 10321986 | | 5/2003 |
| DE | 10254404 | | 11/2004 |
| JP | 11234799 | A | 8/1999 |
| JP | 2006004099 | A | 1/2006 |
| JP | 2006506671 | A | 2/2006 |
| JP | 2006119640 | A | 5/2006 |
| JP | 2008067000 | A | 3/2008 |
| JP | 2009071406 | A | 4/2009 |
| JP | 2010154549 | A | 7/2010 |
| JP | 2010193206 | A5 | 3/2012 |
| WO | WO-2004/047485 | | 6/2004 |
| WO | WO 2004/047485 | | 6/2004 |
| WO | WO-2006/092995 | | 9/2006 |
| WO | WO 2006/092995 | | 9/2006 |

OTHER PUBLICATIONS

Kuntz, A. et al., "A 3D Acoustic Simulation Progrm with Graphical Fronted for Scene Input", Audio Engineering Society; Convention Paper 6741; May 2006; pp. 1-8.

Thiele, G. et al., "Wellenfeldsynthese—Neue Möglichkeiten der Räumlichen Tonaufnahme und—Wiedergabe", FKT Fernseh and Kinotechnik; Fachverlag Schiele & Sohn GmbH; vol. 57; No. 4; Apr. 2003; pp. 735-739.

Boone, M., "Acoustic rendering with wave filed synthesis", ACM Siggraph and Eurographics Campfire: Acoustic Rendering Forvirutal Environments; pp. 1-9 May 2001.

Corteel, E. et al., "Listening Room Compensation for Wave Field Synthesis. What can be done?", Proceedings of the International AES Conference; May 2003; pp. 1-17.

Corteel, E., "Synthesis of Directional Sources Using Wave Field Synthesis, Possibilities, and Limitations", Eurasip Journal an Advances in Signal Processing; vol. 2007; No. 1; Jan. 2007; pp. 1-18.

* cited by examiner

| FIGURE 4 | |
|---|---|
| FIGURE 4A | FIGURE 4B |

APPARATUS, METHOD AND ELECTROACOUSTIC SYSTEM FOR REVERBERATION TIME EXTENSION

CROSS-REFERENCE TO RELATED APPLICATIONS

This application is a continuation of copending International Application No. PCT/EP2012/066392, filed Aug. 23, 2012, which is incorporated herein by reference in its entirety, and additionally claims priority from German Application No. 102011082310.7, filed Sep. 7, 2011, and U.S. Application 61/531,899, filed Sep. 7, 2011, which are all incorporated herein by reference in their entirety.

BACKGROUND OF THE INVENTION

The present invention relates to an apparatus, a method and an electroacoustic system for reverberation time extension.

From an acoustic point of view, a room might not be optimum for different applications. Thus, a musical performance normally necessitates some reverberation to sound good. On the other hand, speakers may partly not be understood when the room is too reverberant. Thus, an adaptation of the reverberation time by means of reverberation systems is useful.

For example, in theaters, conference centers, planetariums, seminar rooms, multifunctional rooms, different acoustic conditions may be needed for different situations, and in particular different requirements with regard to reverberation time are necessitated. For influencing the reverberation time, electroacoustic systems for reverberation time extension can be used. Such systems can either be incorporated into an already existing concert hall, however, it can also be useful to provide an electroacoustic system for reverberation time extension already when constructing and building respective buildings and halls, for example in exhibition construction. Reverberation time extension can also be desirable for audio reproduction for entertainment purposes.

In the following, the wave field synthesis technology will be discussed in more detail. The wave field synthesis (WFS) has been researched at TU Delft and presented for the first time in the late 80's (Berkhout, A. J.; de Vries, D.; Vogel, P.: Acoustic control by Wave-field Synthesis. JASA 93, 1993).

Due to the enormous requirements of this method with regard to computing power and transmission rates, wave field synthesis has so far been hardly applied in practice. Only the progress in the field of microprocessor technology and audio encoding allow today the usage of this technology in specific applications. First products in the professional area are expected next year. The basic idea of WFS is based on the application of the Huygen Principle of wave theory:

Each point captured by a wave is the starting point of an elementary wave spreading spherically or circularly. Applied to acoustics, any form of an incoming wavefront can be reproduced by a large number of loudspeakers arranged next to each other (in a so-called loudspeaker array). In the simplest case of an individual point source to be reproduced and a linear array of loudspeakers, the audio signals of each loudspeaker have to be fed with a time delay and amplitude scaling such that the radiated sound fields of the individual loudspeaker are superimposed properly. For several sound sources, the contribution to each loudspeaker is calculated separately for each source and the resulting signals are added. In a room having reflective walls, reflections can also be reproduced as additional sources via the loudspeaker array. Thus, the calculation effort depends heavily on the number of sound sources, the reflection characteristics of the recording room and the number of loudspeakers.

The advantage of this technology is in particular that a natural spatial sound impression is possible across a large area of the reproduction room. In contrast to the known technologies, direction and distance of sound sources are reproduced very exactly. To a limited extent, virtual sound sources can even be positioned between the real loudspeaker array and the listener.

Thus, by the technology of wave field synthesis (WFS), a good spatial sound can be obtained for a large range of listeners. As has been stated above, the wave field synthesis is based on the principle of Huygens, according to which wavefronts can be formed and built up by superimposing elementary waves. According to a mathematically exact theoretical description, an infinite amount of sources at an infinite small distance would have to be used for generating the elementary waves. Practically, however, a finite amount of loudspeakers are used at a finite small distance to each other. Each of these loudspeakers is controlled according to the WFS principle with an audio signal from a virtual source having a specific delay and a specific level. Level and delays are normally different for all loudspeakers.

As has been stated above, a wave field synthesis system operates based on the Huygen Principle and reconstructs a given waveform of, for example, a virtual source arranged at a specific distance to a listener by a plurality of individual waves. Thus, the wave field synthesis algorithm receives information on the actual position of an individual loudspeaker from the loudspeaker array to calculate then a component signal for this individual loudspeaker, which this loudspeaker then finally has to radiate, so that for the listener a superposition of the loudspeaker signal from the individual loudspeaker with the loudspeaker signals of the other active loudspeakers performs a reconstruction such that the listener has the impression that he is not exposed to sound from many individual loudspeakers but merely from a single loudspeaker at the position of the virtual source.

For several virtual sources in a wave field synthesis setting, the contribution of each virtual source for each loudspeaker, i.e. the component signal of the first virtual source for the first loudspeaker, the second virtual source for the first loudspeaker, etc. is calculated, to then add up the component signals to finally obtain the actual loudspeaker signal. In the case of, for example, three virtual sources, the superposition of the loudspeaker signals of all active loudspeaker would have the effect for the listener that the listener does not have the impression that he is exposed to sound from a large array of loudspeakers, but that the sound that he hears merely originates from three sound sources positioned at specific positions, which are equal to the virtual sources.

In practice, calculation of the component signals is performed mostly in that an audio signal assigned to a virtual source is provided at a specific time with a delay and a scaling factor, depending on the position of the virtual source and the position of the loudspeaker, in order to obtain a delayed and/or scaled audio signal of the virtual source, which represents the loudspeaker signal immediately when only one virtual source exists, or which, after addition with further component signals for the considered loudspeaker from other virtual sources, contributes to the loudspeaker signal for the considered loudspeaker.

Typical wave field synthesis algorithms operate independent of how many loudspeakers exist in the loudspeaker array. The theory underlying wave field synthesis is that each arbitrary sound field can be exactly reconstructed by an infinitely high number of individual loudspeakers, wherein individual loudspeakers are arranged infinitely close to one another. In practice, however, neither the infinitely high number nor the infinitely close arrangement can be realized. Instead, a limited number of loudspeakers exist, which are additionally arranged at specific predetermined intervals to one another. Thereby, in real systems only an approximation of the actual waveform is obtained, which would take place if the virtual source actually existed, i.e. were a real source.

Wave field synthesis means are further able to reproduce several different source types. A prominent source type is the point source where the level decreases proportionally 1/r, wherein r is the distance between a listener and the position of the virtual source. Another source type is a source radiating plane waves. Here, the level remains constant independent of the distance to the listener, since plane waves can be generated by point sources that are arranged at an infinite distance to each other.

After the above excursion on existing wave field synthesis means, we will now deal with systems for reverberation time extension known from conventional technology:

In US005109419A, Griesinger describes an electroacoustic system for reverberation time extension where different sound sources are recorded via microphone or direct input and are artificially reverberated via a reverb matrix. The output signals of this system are output to distributed loudspeakers and thus generate an artificial reverberation in the room.

Also, Poletti describes in "Reverberators for use in wide band assisted reverberation systems" US000000039189E an electroacoustic system for reverberation time extension based on the detection of spatial signals, and processing the same in a delay matrix which again controls a plurality of loudspeakers.

In US0051425869A, Berkhout describes an approach where a signal recorded in a room is convolved and reproduced via a reconstructed wave field.

In patent literature, there are different systems for reverberation time extension, such as U.S. Pat. No. 3,614,320 A and WO 2006092995 A1.

However, none of the systems allow flexible dynamic adaptation to different and alternating acoustic conditions and desires of the users concerning reverberation time extension.

SUMMARY

According to an embodiment, an apparatus for reverberation time extension may have: a module for calculating wave field synthesis information, a signal processor for generating a plurality of audio output signals for a plurality of loudspeakers based on a plurality of audio input signals that have been recorded by a plurality of microphones, and based on the wave field synthesis information, and an operating unit for determining a virtual position of one or several virtual walls, wherein the module for calculating wave field synthesis information is implemented to calculate the wave field synthesis information based on the virtual position of the one or several virtual walls, and wherein, for at least one of the virtual walls, the virtual position is adjustable by the operating unit.

According to another embodiment, a method for reverberation time extension may have the steps of: determining a virtual position of one or several virtual walls; receiving a plurality of audio input signals that have been recorded by a plurality of microphones, calculating wave field synthesis information, and generating a plurality of output signals for a plurality of loudspeakers based on the audio input signals and based on the wave field synthesis information, wherein the wave field synthesis information is calculated based on the virtual position of the one or several virtual walls, and wherein the virtual position is adjustable for at least one of the virtual walls.

Another embodiment may have a computer program having a program code for performing the inventive method, when the computer program runs on a computer.

According to another embodiment, an electroacoustic system for reverberation time extension may have: a plurality of microphones; an inventive apparatus for reverberation time extension, and a loudspeaker array having a plurality of loudspeakers, wherein the plurality of microphones is implemented to generate a plurality of audio input signals fed into the apparatus for reverberation time extension, and wherein the plurality of loudspeakers of the loudspeaker array are implemented to have the audio output signals fed in by the apparatus for reverberation time extension and to reproduce the fed-in audio output signals.

According to another embodiment, a method for reverberation time extension by means of an electroacoustic system may have the steps of: recording a plurality of audio input signals by a plurality of microphones; performing the inventive method for reverberation time extension for generating a plurality of audio output signals, wherein the step of receiving the plurality of audio input signals includes that that plurality of audio input signals that has been recorded by the plurality of microphones is received, and outputting the plurality of audio output signals by means of a loudspeaker array having a plurality of loudspeakers.

The invention provides an apparatus for reverberation time extension. The apparatus comprises a module for calculating wave field synthesis information and a signal processor for generating a plurality of audio output signals for a plurality of loudspeakers based on a plurality of audio input signals, and based on the wave field synthesis information, wherein the audio signals have been recorded or captured by a plurality of microphones. Further, the apparatus comprises an operating unit for determining a virtual position of one or several virtual walls. The module for calculating wave field synthesis information is implemented to calculate the wave field synthesis information based on the virtual position of the one or several virtual walls. Further, the virtual position of at least one of the virtual walls is adjustable by the operating unit.

By shifting the virtual walls towards the outside, an acoustic room expansion is obtained. The acoustic room expansion is additionally obtained by a regenerative effect which consists of recording the generated audio output signals output by the loudspeakers again by the microphones and hence the same are incorporated into the generation of the audio output signals at a later time.

Thus, an apparatus and a method for generating an acoustic room expansion is provided, wherein distributed microphones record relevant sound sources and the acoustic environment and reproduce this with respect to stationary or dynamical virtual source positions via a wave field synthesis system.

The invention is based on the concept that the virtual sources are generated in an algorithm based on wave field synthesis. Here, the invention describes a method wherein, by means of distributed microphones in the room to be reverberated, the acoustics of the room is recorded with the sources to be amplified and supplied to a processing system via AD converters. Here, the processing system can consist of a software where the signal is first processed via filters and then processed in a wave field synthesis algorithm to an object based sound source, which is again processed via filters to be then output via a wave field synthesis system. Due to the options of wave field synthesis, the recorded spatial signals can be positioned in any manner and can be shifted as "virtual walls" in an arbitrary manner. Thereby, individual room geometries can be generated. The recorded spatial signals are typically represented as plane waves and hence correspond to the acoustic effect of a wall. This virtual wall cannot only be shifted but also be amended with respect to its angle and hence influences the reflection patterns of the sound sources directly.

In one embodiment, the module for calculating wave field synthesis information is implemented to calculate delay values and amplitude factor values as wave field synthesis information. Here, the delay value states the delay by which one of the audio input signals is reproduced at one of the loudspeakers in a delayed manner. The amplitude factor value states by what factor the amplitude of one of the audio input signals is modified to obtain a modified signal which is output at one of the loudspeakers.

Further, the module for calculating wave field synthesis information can be implemented to calculate, for any point in time, a delay value and an amplitude factor value for each loudspeaker/virtual wall pair, wherein a loudspeaker/virtual wall pair is a pair of a loudspeaker and one of the virtual walls.

In a further embodiment, the module for calculating wave field synthesis information is implemented to calculate the delay value and the amplitude factor value for a loudspeaker/virtual wall pair based on the distance of the loudspeaker and the virtual wall of the loudspeaker/virtual wall pair.

Further, the module for calculating the wave field synthesis information can be implemented to set the delay value of a loudspeaker/virtual wall pair the higher the greater the distance between the loudspeaker and the virtual wall is.

Further, the module for calculating wave field synthesis information can be implemented to set the amplitude factor value of a loudspeaker/virtual wall pair the smaller the greater the distance between the loudspeaker and the virtual wall is.

In a further embodiment, the operating unit is implemented to shift at least one of the virtual walls from a first virtual position to a second virtual position, such that the virtual wall can be shifted arbitrarily in parallel to its first position. Further, the operating unit can be implemented to shift at least one of the virtual walls from a first virtual position to a second virtual position, such that the virtual wall can be shifted arbitrarily in rotatable manner with respect to its first position.

In a further embodiment, the operating unit is implemented so that the virtual position is adjustable by the operating unit for all of the virtual walls. The operating unit can be implemented such that each of the virtual walls can be shifted from a first virtual position to a second virtual position, such that each virtual wall can be shifted arbitrarily in parallel and in a rotatable manner with respect to its first position.

In a further embodiment the apparatus for reverberation time extension can comprise a parametric filter for filtering resonance frequencies.

Further, an electroacoustic system for reverberation time extension is provided including a plurality of microphones, an apparatus for reverberation time extension according to one of the above described embodiments and a loudspeaker array of a plurality of loudspeakers. Here, the plurality of microphones is implemented to generate a plurality of audio input signals fed into the apparatus for reverberation time extension, and wherein the plurality of loudspeakers of the loudspeaker array are implemented to have the audio signals fed in by the apparatus for reverberation time extension and to reproduce the fed-in audio output signals.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
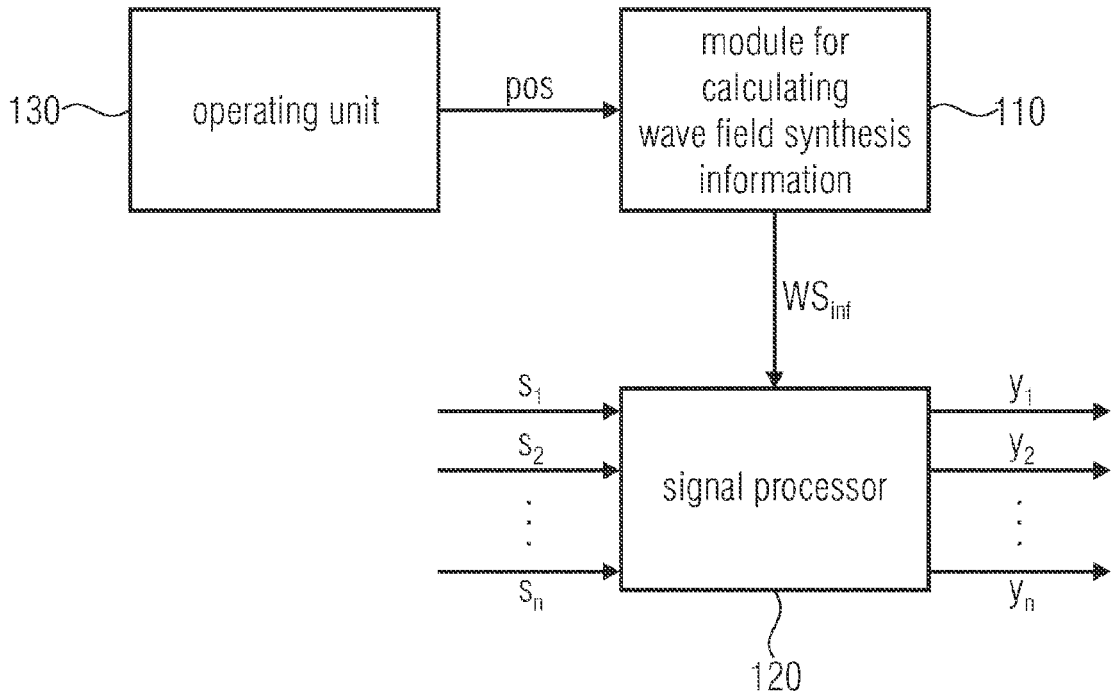
FIG. 1 illustrates a block diagram of an apparatus for reverberation time extension according to an embodiment.

FIG. 1 shows an apparatus for reverberation time extension according to an embodiment. The apparatus comprises a module for calculating wave field synthesis information 110. Further, the apparatus comprises a signal processor 120 for generating a plurality of audio output signals $y_1, y_2, \ldots, y_n$ for a plurality of loudspeakers (not shown) based on a plurality of audio input signals $s_1, s_2, \ldots, s_n$ that have been recorded by a plurality of microphones (not shown), and based on the wave field synthesis information. Further, the apparatus comprises an operating unit 130 for determining a virtual position of one or several virtual walls. Here, the module for calculating wave field synthesis information 110 is implemented to calculate the wave field synthesis information $WS_{inf}$ based on the virtual position of the one or several virtual walls. Here, for at least one of the virtual walls, its virtual position is adjustable by the operating unit. In one embodiment, the module for calculating wave field synthesis information 110 and the signal processor 120 can be realized in one module (a wave field synthesis module).

Figure 2:
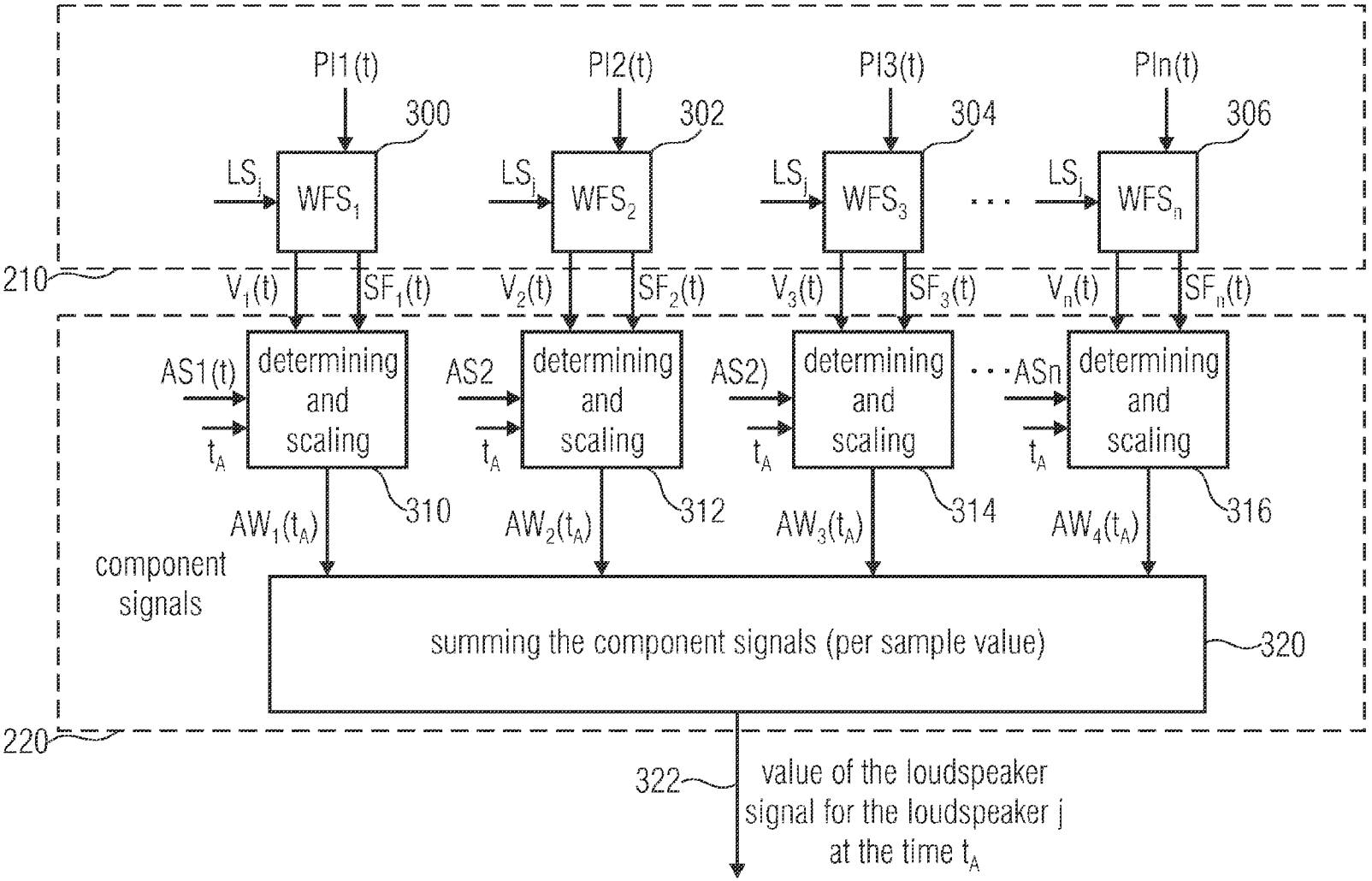
FIG. 2 illustrates a block diagram showing the cooperation of a module for calculating wave field synthesis information and a signal processor.

In the following, with reference to FIG. 2, an implementation of the cooperation of the module for calculating wave field synthesis information and the signal processor will be illustrated. In FIG. 2, the module for calculating wave field synthesis 210 and the signal processor 220 are illustrated by dotted lines.

The module for calculating wave field synthesis information 210 and the signal processor 202 have a strongly parallel structure in that starting from the audio signal supplied to the signal processor for each virtual wall (a virtual source) and starting from the position information for the respective virtual wall (virtual source), which the module for calculating wave field synthesis information 210 has received from an operating unit, first, delay information $V_i$ as well as amplitude factors (scaling factors) $SF_i$ are calculated, which depend on the position information and the position of the just considered loudspeaker, i.e. the loudspeaker with the ordinal number j, i.e. $LS_j$. Calculating delay information $V_i$ as well as a scaling factor $SF_i$ based on the position information of a virtual source (virtual wall) and the position of the considered loudspeaker j takes place by known algorithms that are implemented in means 300, 302, 304, 306.

Based on the delay information $V_i(t)$ and $SF_i(t)$ as well as based on the audio signal $AS_i(t)$ assigned to the individual virtual source, a discrete value $AW_i(t_A)$ for a current time $t_A$ is calculated for the component signal $K_{ij}$ in a finally obtained loudspeaker signal. This is performed by means 310, 312, 314, 316 as shown schematically in FIG. 2. FIG. 2 further shows actually a "flash shot" at the time $t_A$ for the individual component signals. The individual component signals are then combined to nodes by a summator 320, in order to determine the discrete value for the current time $t_A$ of the loudspeaker signal for the loudspeaker j which can then be supplied to the loudspeaker for outputting.

As can be seen in FIG. 2, first, a value valid at the current time is calculated for each virtual source individually based on delay information and a scaling with an amplitude factor (scaling factor), whereupon all component signals for one loudspeaker are summed based on the different virtual walls (virtual sources). If, for example, only one virtual source existed, the summator would be omitted, and the signal applied at the output of the summator in FIG. 2 would, for example, correspond to the signal output by means 310 when the virtual source 1 is the only virtual source.

Here, it should be noted that the value of a loudspeaker signal is obtained at the respective output, which is a superposition of the component signals for this loudspeaker due to the different virtual sources 1, 2, 3, . . . , n. Such an array would basically be provided for each loudspeaker, except that for example 2, 4 or 8 combined loudspeakers are controlled by the same loudspeaker signal, which is advantageous for practical reasons.

Figure 3:
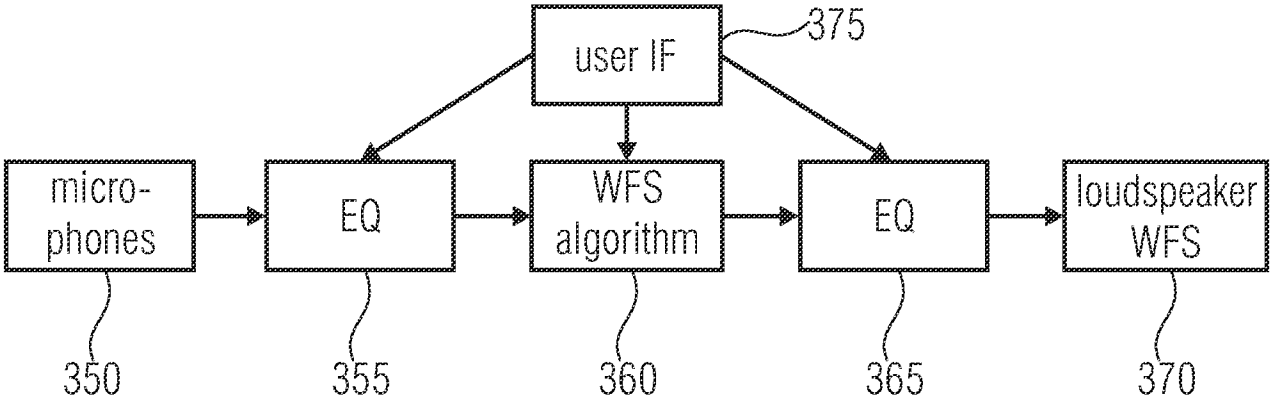
FIG. 3 illustrates an electroacoustic WFS system for reverberation time extension according to an embodiment.

FIG. 3 represents an electroacoustic WFS system for reverberation time extension according to an embodiment.

According to the embodiment of FIG. 3, four microphones 350 are evenly installed in a room, suspended from the ceiling by one meter. The microphone signals are processed to one virtual source in a WFS algorithm 360, which is reproduced in the same room as plane wave via a WFS reverberation system 370. The WFS system includes an operating surface for moving the four microphone sources. With this operation unit, the four microphone signals are recorded and pulled towards the outside. The result is an acoustic extension of the room.

In that way, rooms of any size can be generated. By positioning the virtual walls, the reverberation time of the room changes with respect to the position and arrangement (angle) of the walls.

In one embodiment, the wave field synthesis module 360 includes a module for calculating wave field synthesis information according to the embodiment of FIG. 1 and a signal processor according to the embodiment of FIG. 1.

In one embodiment, the operating unit 375 is an operating unit according to the embodiment of FIG. 1.

According to an embodiment, unit 355 in FIG. 3 represents a filter that serves to filter resonance frequencies. A sound wave output at one of the loudspeakers 370 is again recorded by the microphones 350 and considered again when generating the later audio signal output via the loudspeakers. In order to avoid occurring undesired resonances, the filter 355 can be used for suppressing these resonances.

According to one embodiment, the filter 365 can be a conventional filter that serves, for example, to adapt the loudspeakers.

Figure 4A:
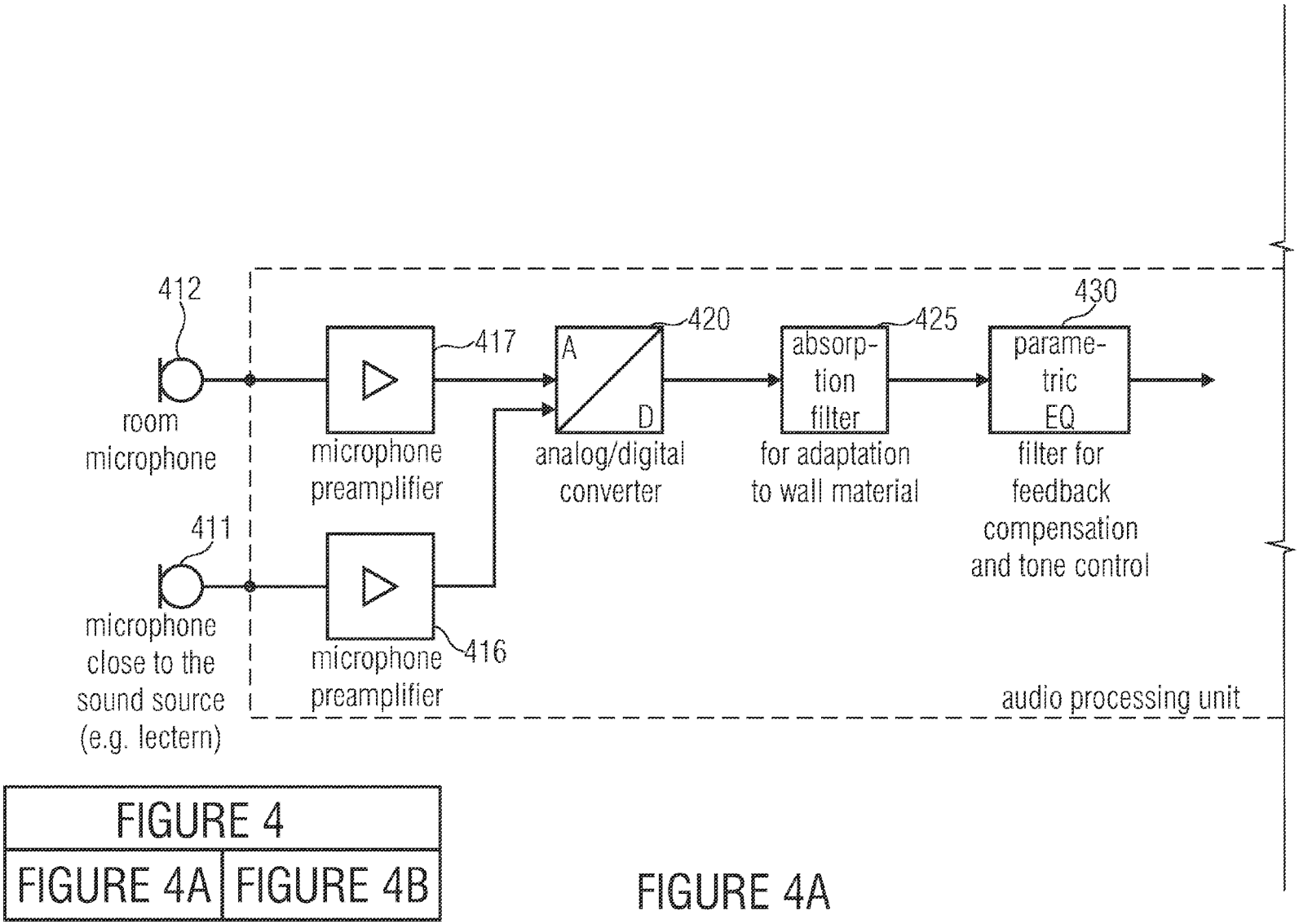
FIG. 4 illustrates a further embodiment of an electroacoustic WFS system.
Figure 4B:
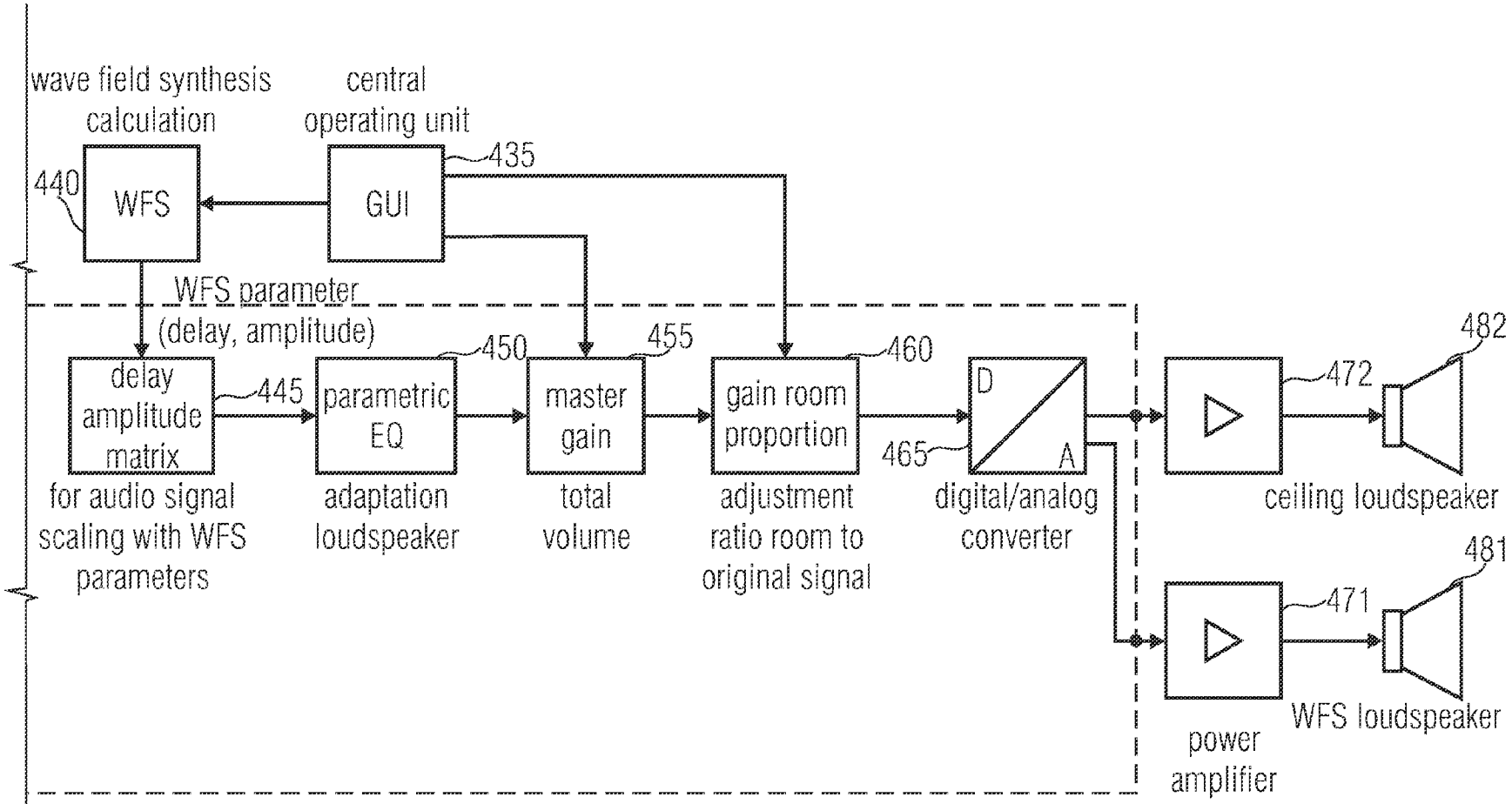

FIG. 4 illustrates a further embodiment of an electroacoustic WFS system. The signals of the ceiling microphones are processed in a central processing unit and processed to virtual sources after filtering in a matrix, which is again reproduced after level adaptation, regulation of the room proportion and the loudspeaker filtering as virtual sound sources via a WFS array and equally distributed ceiling loudspeakers.

In FIG. 4, microphones 411, 412 feed audio input signals into microphone preamplifiers 416, 417. The microphone 411 is a microphone which is close to a sound source, e.g. a lectern. The microphone 412 is a room microphone which is within the room but more distant from the sound source than the microphone 411. Normally, several room microphones and/or several microphones close to the sound source are used.

Microphone preamplifiers 416, 417 amplify the audio input signals received from the microphones 411, 412 to obtain preamplified audio input signals. The microphone preamplifiers 416, 417 can be common microphone preamplifiers. The preamplified audio input signals are fed into an analog digital converter 420 which converts the audio signals, which are first in analog form, into digital audio signals. The analog digital converter 420 can be a common analog digital converter.

The analog digital converter 420 feeds the digital audio signals into an absorption filter 425. The absorption filter 425 performs filtering, which serves to adapt the same to the wall material. In one embodiment, the absorption filter 425 filters such that, when heavily reflecting walls are to be reproduced, the digital audio signals pass the absorption filter 425 in an almost unfiltered manner. If, however, heavily attenuating walls are to be reproduced, in one embodiment, the absorption filter 425 filters the digital audio signal to a great extent.

Filter 430 is a filter for feedback compensation and tone control. If a loudspeaker speaker reproduces a signal, the sound waves of this signal are again recorded by the microphone and this results in a feedback. In one embodiment, the filter 430 can be used to compensate this feedback completely or partly. Additionally, the filter 430 can be used for tone control. In one embodiment, the feedback compensation and/or the tone control can be performed in a conventional manner.

Further, the system in FIG. 4 includes a central operating unit 435 and a module for calculating wave field synthesis information 440. Here, the central operating unit 435 can correspond to the operating unit in FIG. 1. The central operating unit in FIG. 4 can be provided with a GUI (Graphical User Interface). The module for calculating wave field synthesis information 440 can correspond to the module for calculating wave field synthesis information of FIG. 1.

The module for calculating wave field synthesis information 440 passes the calculated wave field synthesis parameter on to the module 445. These wave field synthesis parameters can, for example, be delay values and amplitude values, such as amplitude factor values.

The module 445 builds a delay amplitude matrix from the values passed on by module 440. In one embodiment, the delay amplitude matrix can include, for example, one delay value and one amplitude factor for a specific time for each loudspeaker/virtual wall pair.

The module 445 performs audio scaling based on the wave field synthesis parameters obtained from the module for calculating wave field synthesis information 440. If, for example, a delay value and an amplitude factor value have been obtained for a loudspeaker/virtual wall pair, for example the signal radiated by the virtual wall (e.g. seemingly reflected by the virtual wall) is delayed by the obtained delay value, and the amplitude factor value obtained from the module 440 is modified by the amplitude factor value to the amplitude of the signal to be output, for example by multiplying the amplitude factor value with the amplitude of the signal to be output.

In the following, the filter 450 filters the audio signals modified by the module 445 to obtain loudspeaker adaptation. In a master gain module 455, the audio signals are modified to adjust the total volume. This can take place in a conventional manner. In a gain room proportion module 460, adjustment of the ratio room proportion to original signal is performed. In one embodiment, for example, the ratio of audio signals generated from audio signals of room microphones to audio signals generated from audio signals of microphones close to the lectern is adjustable, for example by adjusting the amplitudes of the respective signals.

The modified digital audio signals are then fed into a digital analog converter 465 that converts the modified digital audio signals into analog audio output signals. The analog audio output signals are then amplified by power amplifiers 471, 472 and output by loudspeakers 481, 482. In the embodiment of FIG. 4, the audio signals are output either by WFS loudspeakers 481 or ceiling loudspeakers 482. It is obvious that a plurality of WFS loudspeakers and/or ceiling loudspeakers can be used in a real system.

Figure 5:
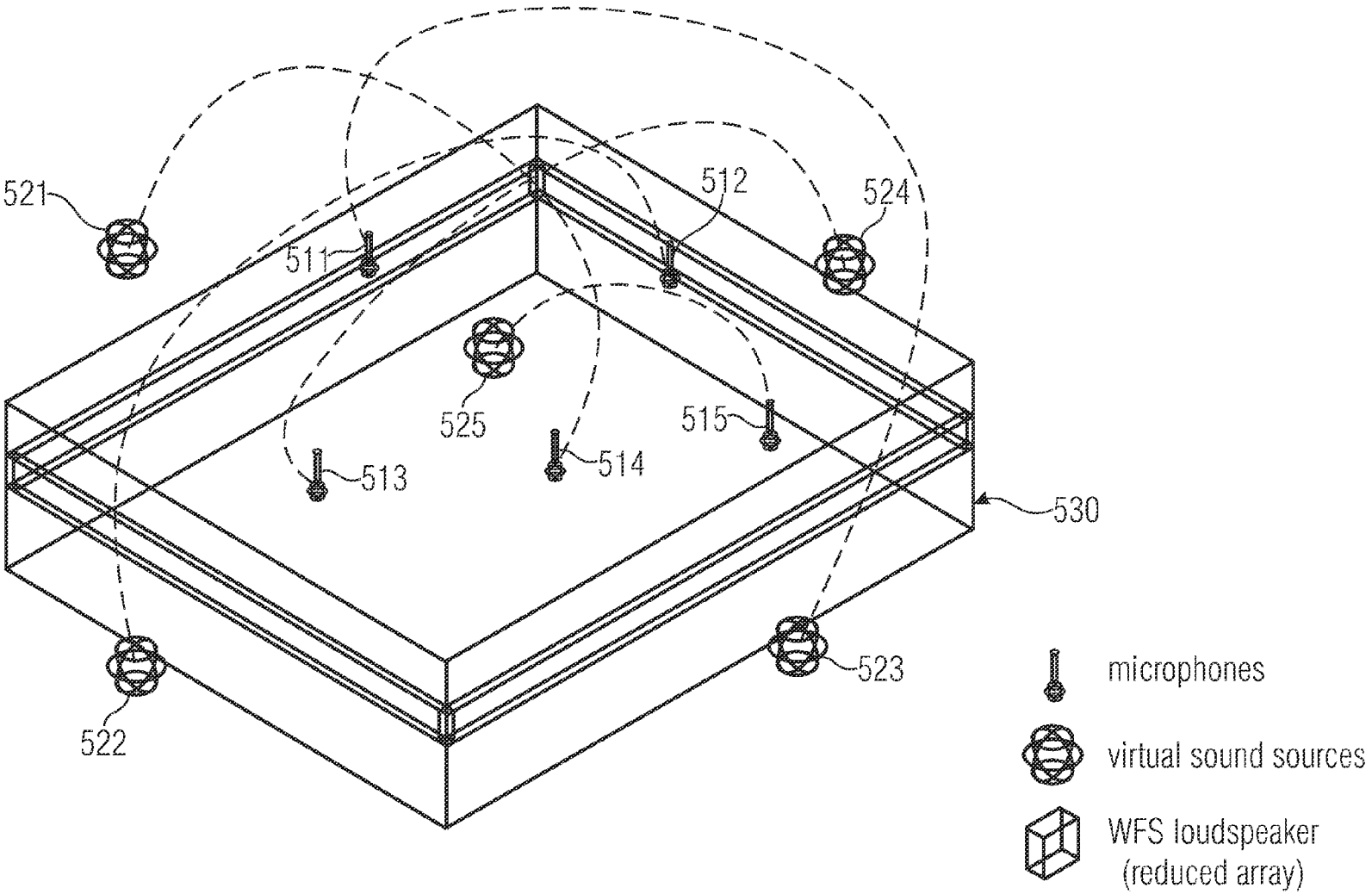
FIG. 5 illustrates an average conference room (5 m×18 m×15 m) provided with five ceiling microphones, 40 ceiling loudspeakers and a circumferential horizontal strip of conventional loudspeakers in a reduced WFS array according to an embodiment.

FIG. 5 shows an average conference room (5 m×18 m×15 m) provided with 5 ceiling microphones 511, 512, 513, 514, 515, 40 ceiling loudspeakers and a circumferential horizontal strip of conventional loudspeakers in a reduced WFS array 530. The signals of the ceiling microphones 511, 512, 513, 514, 515 are processed in a central processing unit and processed into virtual sources in a matrix after filtering, which is output again after level adaptation, regulation of the room proportion and loudspeaker filtering as virtual sound sources 521, 522, 523, 524, 525 via a WFS array and equally distributed ceiling loudspeakers. FIG. 4 shows the structure. Here, the microphone signals are represented by the respectively opposing virtual sources to prevent feedbacks. By using a flexible matrix and the option of representing any inputs (microphone inputs/line In) as virtual sound sources 521, 522, 523, 524, 525, directly microphoned signals are incorporated into the room simulation and due to their positioning they are also used for representation in an artificially reverberation extended room. However, these signals have to be considered as only hardly regenerative, since they barely include room proportions. Further microphones can be added to record a complex distribution of reflections. Also, the representation of virtual sound sources 521, 522, 523, 524, 525 on the ceiling is possible, which can be considered as significant quality requirement when representing a real room. In the input branch of the matrix, there is, apart from a filter unit with narrow band filters for feedback suppression, also a filter unit considering different room materials in order to incorporate different absorption and reflection parameters in the room to be reverberated. The detected microphone signals are, as described, again modelled into freely positionable sources and, provided with the existing room characteristics, again recorded by the microphone which results in a regeneration of the room acoustics.

Figure 6:
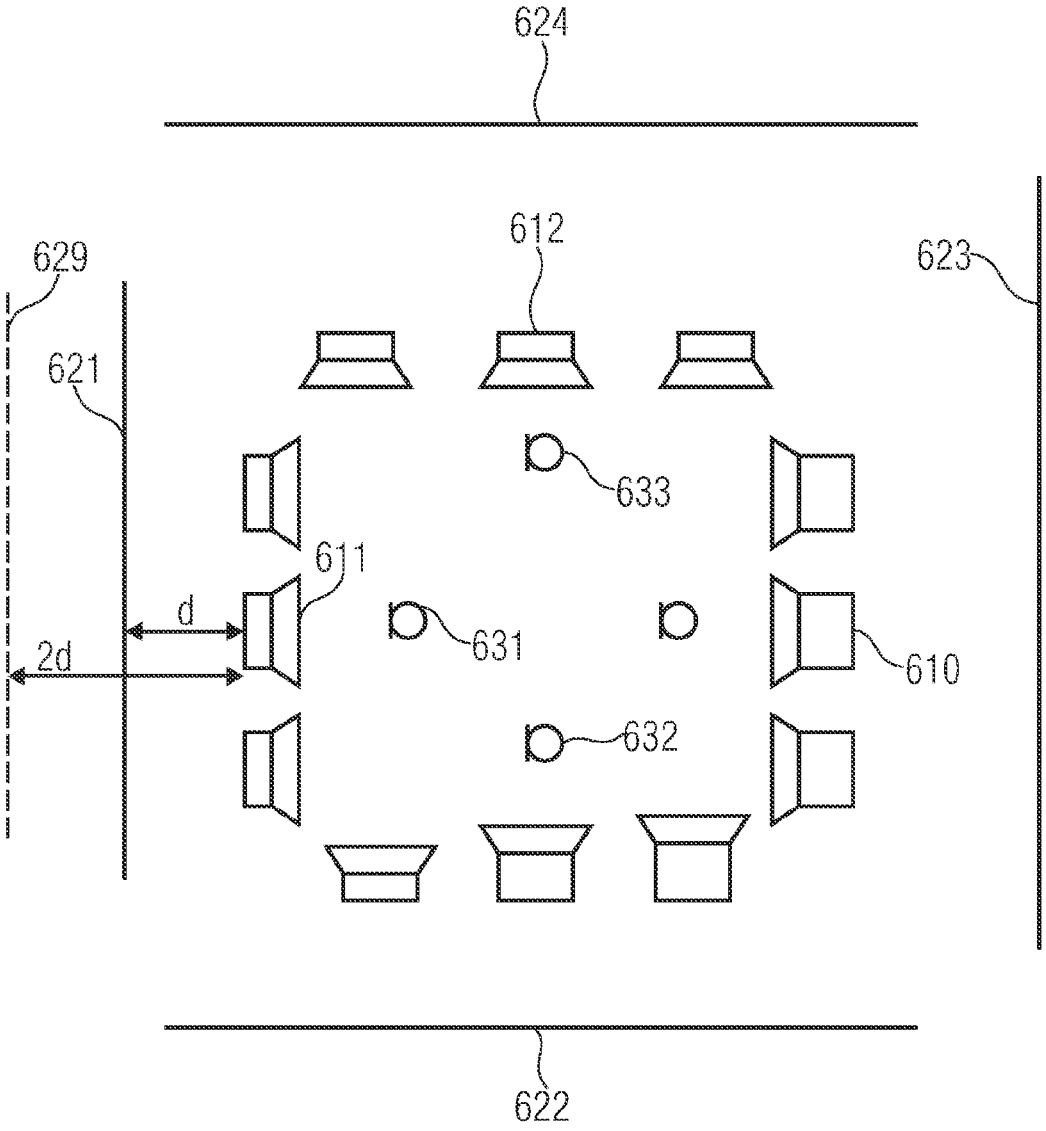
FIG. 6 shows an array of loudspeaker, virtual walls and microphones according to an embodiment.

FIG. 6 illustrates a basic concept of specific embodiments. A loudspeaker array comprising, as shown in FIG. 6, 12 loudspeakers 611, 612, 613 is illustrated. In real embodiments, the number of loudspeakers will frequently be significantly higher and comprises, for example, 60, 100, 200, 300 or more loudspeakers. Additionally, four virtual walls 621, 622, 623, 624 are illustrated.

In the following, the loudspeaker 611 and the virtual wall 621 will be considered in more detail. The same form a loudspeaker/virtual wall pair (611, 621). Any other combination of one of the loudspeakers and one of the virtual walls also forms a loudspeaker/virtual wall pair. The distance between the loudspeaker and the virtual wall is indicated by an arrow d. In FIG. 6, additionally, a plurality of microphones 631, 632, 633 are provided. For simplicity reasons, it is assumed that a microphone 631 produces an audio signal by recording sound waves, which is to be reproduced via the loudspeaker 611. Here, the signal reproduced by the loudspeaker 611 is to correspond to a reflection of the sound waves recorded by the microphone 631 at the virtual wall 621. This means that the signal recorded by the microphone can only be reproduced with a time delay by the loudspeaker 611, which depends on the distance between loudspeaker and virtual wall: the higher the distance between virtual wall 621 and loudspeaker 611, the greater the time delay, i.e. the delay value by which the signal recorded by the microphone 631 is to be reproduced at the loudspeaker 611. FIG. 6 shows a shift of the virtual wall 621 by the dotted line 629, wherein the distance of the virtual wall to the loudspeaker 611 increases from d to 2 d. The delay value increases accordingly.

In a specific embodiment, the delay value can be calculated according to the formula:

$$\text{Delay}=(d+c)*p_1$$

wherein d is the distance between the loudspeaker and the virtual wall of the loudspeaker/virtual wall pair, c is a constant value and $p_1$ a proportionality constant greater than 0. The delay value becomes the greater the greater the distance between loudspeaker and virtual wall is.

The higher the distance between virtual wall and loudspeaker becomes, the smaller, in one embodiment, the amplitude factor is to be selected since also the amplitude of a real sound source becomes the smaller the further away one is from a sound source, wherein the virtual sound source represents the virtual wall that seemingly reflects a sound wave. The amplitude factor is the factor by which the amplitude of one of the output signals is to be modified to obtain a modified signal which is to be output at one of the loudspeakers.

In a specific embodiment, the amplitude factor can be calculated according to the formula:

$$\text{amplitude factor}=[1/(d+h)]*p_2$$

wherein d is the distance between loudspeaker and virtual wall of the loudspeaker/virtual wall pair, h a constant value and $p_2$ a proportionality constant greater than 0. In embodiments, the proportionality constant $p_2$ is selected such that the amplitude factor assumes a value greater than 0 and less than 1.

Basically, increasing the delay value can cause reverberation time extension.

Figure 7:
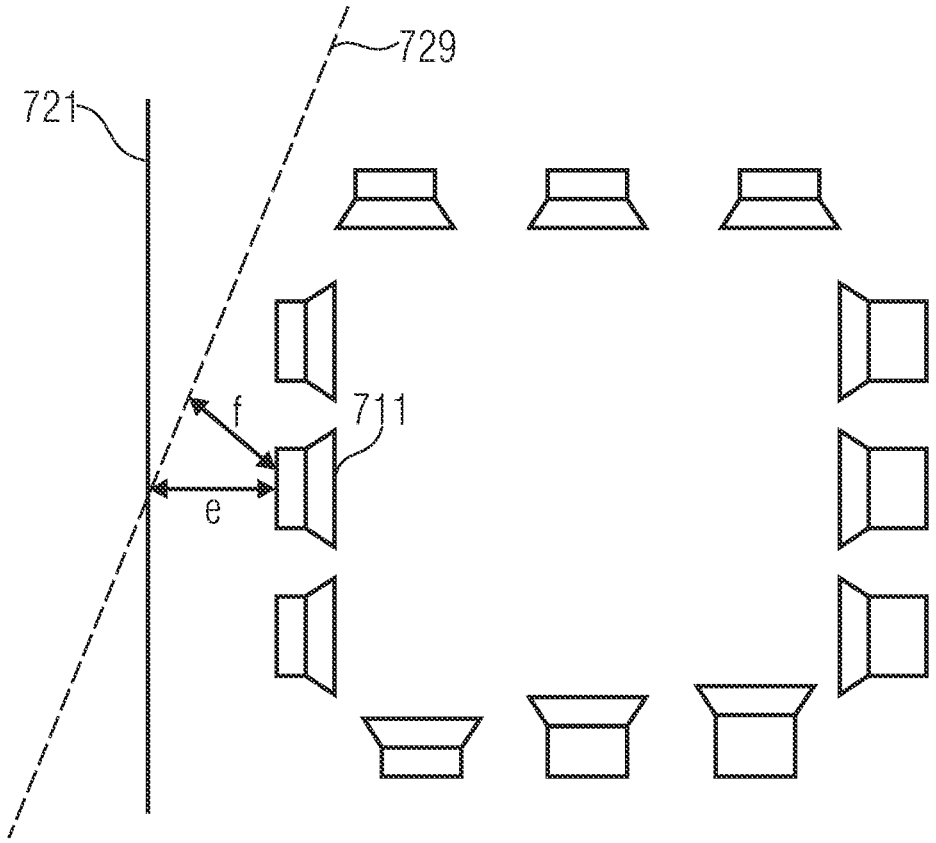
FIG. 7 shows an array of loudspeakers and a virtual wall according to a further embodiment.

FIG. 7 shows a further embodiment where the current position 729 of the virtual wall is changed such that the current position 729 of the virtual wall has been changed in a rotatable manner with respect to its old position 721. The distance of the old position of the virtual wall to the loudspeaker 711 is illustrated by arrow e, the distance of the new position of the virtual wall to the loudspeaker 711 is illustrated by arrow f.

While some aspects have been described in the context of an apparatus, it is obvious that these aspects also represent a description of the respective method, wherein a block or an apparatus corresponds to a method step or a feature of a method step. Analogously, aspects that have been described in the context of a method step represent also a description of a respective block or element or feature of a respective apparatus.

An inventive computer program or signal can be stored in a digital memory medium or can be transferred on a transfer medium, such as a wireless transfer medium or a wired transfer medium, such as the Internet.

Depending on specific implementation requirements, embodiments of the invention can be implemented in hardware or in software. The implementation can be made by using a digital memory medium, such as a disc, a DVD, a CD, an ROM, a PROM, an EPROM, an EEPROM or a Flash memory on which electronically readable control signals are stored, which cooperate (or are able to cooperate) with a programmable computer system such that the respective method is performed.

Some embodiments according to the invention comprise a non-transitory data carrier having electronically readable control signals that are able to cooperate with a programmable computer system such that one of the methods described herein is performed.

Generally, embodiments of the present invention can be implemented as a computer program product with a program code, wherein the program code is effective to preform one of the methods when the computer program product is performed on a computer. The program code can be stored, for example, on a machine readable carrier.

Other embodiments comprise the computer program for preforming one of the methods described herein, stored on a machine readable carrier.

In other words, one embodiment of the inventive method is a computer program with a program code for executing one of the methods described herein when the computer program is performed on a computer.

A further embodiment of the inventive method is a data carrier (or a digital memory medium or a computer readable medium) which comprises, recorded on the same, the computer program for performing one of the methods described herein.

Thus, a further embodiment of the inventive method is a data stream or a series of signals representing the computer program for executing one of the methods described herein. The data stream or the series of signals can be configured to be transmitted via a data communication connection, such as via the Internet.

A further embodiment comprises a processing means, for example a computer or a programmable logic device which is configured or adapted to perform one of the methods described herein.

A further embodiment comprises a computer on which the computer program for performing one of the methods described herein is installed.

In some embodiments, a programmable logic device (for example a field programmable gate array) can be used to perform one or all of the functionalities of the methods described herein. In some embodiments, a field programmable gate array can cooperate with a microprocessor to perform one of the methods described herein. Generally, the methods are performed by any hardware device.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Apparatus for reverberation time extension, comprising:

a module for calculating wave field synthesis information, a signal processor for generating a plurality of audio output signals for a plurality of loudspeakers based on a plurality of audio input signals that have been recorded by a plurality of microphones, and based on the wave field synthesis information, and an operating unit for determining a virtual position of one or several virtual walls, wherein the module for calculating wave field synthesis information is implemented to calculate the wave field synthesis information based on the virtual position of the one or several virtual walls, wherein, for at least one of the virtual walls, the virtual position is adjustable by the operating unit, and wherein the module for calculating wave field synthesis information is implemented using a hardware apparatus or using a computer or using a combination of a hardware apparatus and a computer.

2. Apparatus according to claim 1, wherein the module for calculating wave field synthesis information is implemented to calculate delay values and amplitude factor values as wave field synthesis information, wherein the delay value indicates the delay by which one of the audio input signals is reproduced at one of the loudspeakers in a delayed manner, and wherein the amplitude factor indicates by what factor the amplitude of one of the audio input signals is modified to acquire a modified signal which is output at one of the loudspeakers.

3. Apparatus according to claim 2, wherein the module for calculating wave field synthesis information is implemented to calculate a delay value and an amplitude factor for each loudspeaker/virtual wall pair for a specific time, wherein a loudspeaker/virtual wall pair is a pair of one of the loudspeakers and one of the virtual walls.

4. Apparatus according to claim 3, wherein the module for calculating wave field synthesis information is implemented to calculate the delay value and the amplitude factor value for a loudspeaker/virtual wall pair based on the distance of the loudspeaker and the virtual wall of the loudspeaker/virtual wall pair.

5. Apparatus according to claim 3, wherein the module for calculating wave field synthesis information is implemented to set the delay value of a loudspeaker/virtual wall pair the greater the greater the distance between the loudspeaker and the virtual wall is.

6. Apparatus according to claim 3, wherein the module for calculating wave field synthesis information is implemented to set the amplitude value of a loudspeaker/virtual wall pair the smaller the greater the distance between the loudspeaker and the virtual wall is.

7. Apparatus according to claim 1, wherein the operating unit is implemented such that at least one of the virtual walls can be shifted from a first virtual position to a second virtual position, such that the virtual wall can be shifted arbitrarily in parallel to its first position.

8. Apparatus according to claim 1, wherein the operating unit is implemented such that at least one of the virtual walls can be shifted from a first virtual position to a second virtual position, such that the virtual wall can be shifted arbitrarily in a rotatable manner with respect to this first position.

9. Apparatus according to claim 1, wherein the virtual position for all of the virtual walls is adjustable by the operating unit.

10. Apparatus according to claim 1, wherein the operating unit is implemented such that each of the virtual walls can be shifted from a first virtual position to a second virtual position, such that each virtual wall can be shifted arbitrarily in parallel and in a rotatable manner with respect to its first position.

11. Apparatus according to claim 1, wherein the apparatus further comprises a parametric filter for filtering resonance frequencies.

12. Method for reverberation time extension, comprising:

determining a virtual position of one or several virtual walls;

receiving a plurality of audio input signals that have been recorded by a plurality of microphones, calculating wave field synthesis information, and generating a plurality of output signals for a plurality of loudspeakers based on the audio input signals and based on the wave field synthesis information, wherein the wave field synthesis information is calculated based on the virtual position of the one or several virtual walls, and wherein the virtual position is adjustable for at least one of the virtual walls.

13. A non-transitory computer-readable medium comprising a computer program including a program code for performing the method according to claim 12, when the computer program runs on a computer.

14. Electroacoustic system for reverberation time extension, comprising:

a plurality of microphones;

an apparatus for reverberation time extension according to claim 1, and a loudspeaker array comprising a plurality of loudspeakers, wherein the plurality of microphones is implemented to generate a plurality of audio input signals fed into the apparatus for reverberation time extension, and wherein the plurality of loudspeakers of the loudspeaker array are implemented to have the audio output signals fed in by the apparatus for reverberation time extension and to reproduce the fed-in audio output signals.

15. Method for reverberation time extension by means of an electroacoustic system, comprising:

recording a plurality of audio input signals by a plurality of microphones;

performing the method for reverberation time extension according to claim 12 for generating a plurality of audio output signals, wherein receiving the plurality of audio input signals comprises that that plurality of audio input signals that have been recorded by the plurality of microphones is received, and outputting the plurality of audio output signals by means of a loudspeaker array comprising a plurality of loudspeakers.

* * * * *